US005787869A

United States Patent [19]

Johnson et al.

[11] Patent Number: 5,787,869

[45] Date of Patent: Aug. 4, 1998

[54] COMPRESSED AIR TOY GUN

[75] Inventors: Lonnie G. Johnson, Smyrna; John T. Applewhite, Atlanta; Shane Matthews, Marietta, all of Ga.

[73] Assignee: Johnson Research & Development Corp., Inc., Atlanta, Ga.

[21] Appl. No.: 799,702

[22] Filed: Feb. 11, 1997

Related U.S. Application Data

[63] Continuation-in-part of Ser. No. 730,619, Oct. 21, 1996, Pat. No. 5,709,199, which is a continuation-in-part of Ser. No. 699,431, Aug. 19, 1996, Pat. No. 5,699,781, which is a continuation-in-part of Ser. No. 494,407, Jun. 26, 1995, Pat. No. 5,592,931, which is a continuation-in-part of Ser. No. 441,229, May 15, 1995, Pat. No. 5,596,978.

[51] Int. Cl.[6] ..... F41B 11/00; F41B 9/00

[52] U.S. Cl. ..... 124/69; 124/83; 124/85

[58] Field of Search ..... 124/69, 63, 72, 124/53.5, 48, 59, 81, 82, 83, 84, 85; 42/77, 76.01

[56] References Cited

U.S. PATENT DOCUMENTS

| | | | |
|---|---|---|---|
| 2,147,003 | 2/1939 | Von Kozurik | 124/11 |
| 2,312,244 | 2/1943 | Feltman | 124/11 |
| 2,357,951 | 9/1944 | Hale | 124/11 |
| 2,654,973 | 10/1953 | Lemelson | 46/56 |
| 2,733,699 | 2/1956 | Krinsky | 124/13 |
| 2,927,398 | 6/1960 | Kaye et al. | 46/74 |
| 3,025,633 | 6/1962 | Kaye et al. | 46/74 |
| 3,121,292 | 2/1964 | Butler et al. | 46/74 |
| 3,139,692 | 7/1964 | Sellers et al. | 124/83 X |
| 3,262,440 | 7/1966 | Kuhn | 124/83 X |
| 3,397,476 | 8/1968 | Weber | 43/6 |
| 3,859,977 | 1/1975 | Lange | 124/83 X |
| 3,962,818 | 6/1976 | Pippin | 46/74 |
| 4,073,280 | 2/1978 | Koehn | 124/72 |
| 4,083,349 | 4/1978 | Clifford | 124/72 |
| 4,159,705 | 7/1979 | Jacoby | 124/63 |
| 4,223,472 | 9/1980 | Feket et al. | 46/44 |
| 4,411,249 | 10/1983 | Fogarty et al. | 124/64 |
| 4,559,737 | 12/1985 | Washington | 124/83 X |
| 4,890,767 | 1/1990 | Burlison | 222/78 |
| 4,897,065 | 1/1990 | Fertig et al. | 446/63 |
| 5,090,708 | 2/1992 | Gerlitz et al. | 273/310 |
| 5,188,557 | 2/1993 | Brown | 446/212 |
| 5,228,427 | 7/1993 | Gargner, Jr. | 124/81 |
| 5,280,917 | 1/1994 | Ortiz | 273/318 |
| 5,343,849 | 9/1994 | Steer | 124/72 |
| 5,343,850 | 9/1994 | Steer | 124/64 |
| 5,370,278 | 12/1994 | Raynie | 222/175 |
| 5,373,832 | 12/1994 | D'Andrade | 124/69 |
| 5,415,152 | 5/1995 | Adamson et al. | 124/59 |
| 5,640,945 | 6/1997 | Slonaker et al. | 124/56 |

FOREIGN PATENT DOCUMENTS

2587911-A1 10/1985 France .

*Primary Examiner*—John A. Ricci
*Assistant Examiner*—Thomas A. Beach
*Attorney, Agent, or Firm*—Kennedy, Davis & Kennedy

[57] ABSTRACT

An air compressed gun (10) is provided having a stock (11), a barrel (12), a trigger (13) and a manual air pump (14). The gun also has a mounting tube (201) configured to be received within the tail bore (203) of a projectile (P) and a barrel (200) in which the projectile is positioned for launching. The mounting tube has a tapered air exit end (210) and a safety bar (211). The barrel has an lelongated slot (217) for venting compressed air.

15 Claims, 9 Drawing Sheets

COMPRESSED AIR TOY GUN

REFERENCE TO RELATED APPLICATION

This is a continuation-in-part of application Ser. No. 08/730,619 filed Oct. 21, 1996 now U.S. Pat. No. 5,709,199, which is a continuation-in-part of application Ser. No. 08/699,431 filed Aug. 19, 1996 now U.S. Pat. No. 5,699,781, which is a continuation-in-part of application Ser. No. 08/494,407 filed Jun. 26, 1995 now U.S. Pat. No. 5,592,931, which is a continuation-in-part of application Ser. No. 08/441,229 filed May 15, 1995, now U.S. Pat No. 5,596,928.

TECHNICAL FIELD

This invention relates to compressed air guns, and specifically to compressed air toy guns having a safety feature to prevent the launching of foreign projectiles.

BACKGROUND OF THE INVENTION

Toy guns which shoot or launch projectiles have been very popular for many years. These guns have been designed to launch projectiles in a number of ways. A common method of launching has been by the compression of a spring which propels the projectile upon its decompression or release, as, for example, with BB guns and dart guns. These guns however usually do not generate enough force to launch projectiles with great velocity.

Toy guns have also been designed which use compressed air to launch projectiles such as foam darts. These types of guns use a reciprocating air pump to pressurize air within a pressure tank. In use, a single dart is loaded and the pump is typically reciprocated several times with each firing of the gun. Therefore, the gun must be loaded and pumped with each firing as it is not capable of firing several darts in rapid sequence. The rapid firing of a gun may be desired for those playing a mock war or other type of competition.

As children often become bored with the design of conventional guns it is desirous to design guns having an unconventional construction or appearance. However, unconventional guns are often difficult to accurately aim and fire.

Today children who play mock wars often carry several guns at one time in order to fire several shots simultaneously or in rapid succession. This however is difficult as two hands must be used to fire two separate guns and two hands are typically used to pump one gun. Hence, a child must choose to either fire a gun in each hand or pump one gun for firing.

Another problem associated with dart guns which fire cylindrical, foam darts has been their inconsistent aim. It has been discovered that this inconsistency is attributed to the pressures exerted upon the tail end of a dart as it exits the launch tube. For should the dart be slightly misaligned or the tail not be perfectly even, the compressed air within the launch tube rushes about the tail as it exits the launch tube, thereby causing a skewing force which causes the dart to veer or even tumble during flight.

A safety problem has also existed associated with children forcing foreign objects into the launch tube other than the specifically designed foam dart. For example, a child may force a sharpened pencil into the launch tube which could be fired by the compressed air.

In the past designers of compressed air dart guns have tried to overcome this problem of firing foreign objects. For example, dart guns have been designed which include an air release safety valve which co-operates with a pin extending into the launch tube. The placement of a properly configured dart within the launch tube biases the pin so as to open the safety valve. Now, with the firing of the gun compressed air is allowed into the launch tube through the safety valve. Should the safety valve not be biased to its open position the compressed air is prevented from flowing into the launch tube. The problem with these types of dart guns however has been the complexity associated with their construction.

Accordingly, it is seen that a need remains for a toy air gun which may be safely fired should a foreign object be inserted into its launch tube and which may accurately launch a dart. It is to the provision of such therefore that the present invention is primarily directed.

SUMMARY OF THE INVENTION

In a preferred form of the invention a compressed air toy gun for firing projectiles having a tail bore comprises pump means for compressing air, conduit means in fluid communication with the pump means for conveying compressed air from the pump means, and launch tube means in fluid communication with the conduit means for holding and launching a projectile. The launch tube means has an outer barrel having a projectile exit end and an inner tube mounted longitudinally within and spaced from the outer barrel. The inner tube has an air entry end and an air exit end positioned distally from the barrel projectile exit end. The barrel has a vent extending from adjacent the projectile end to a position at least generally level with the tube air exit end.

DETAILED DESCRIPTION

Figure 1:
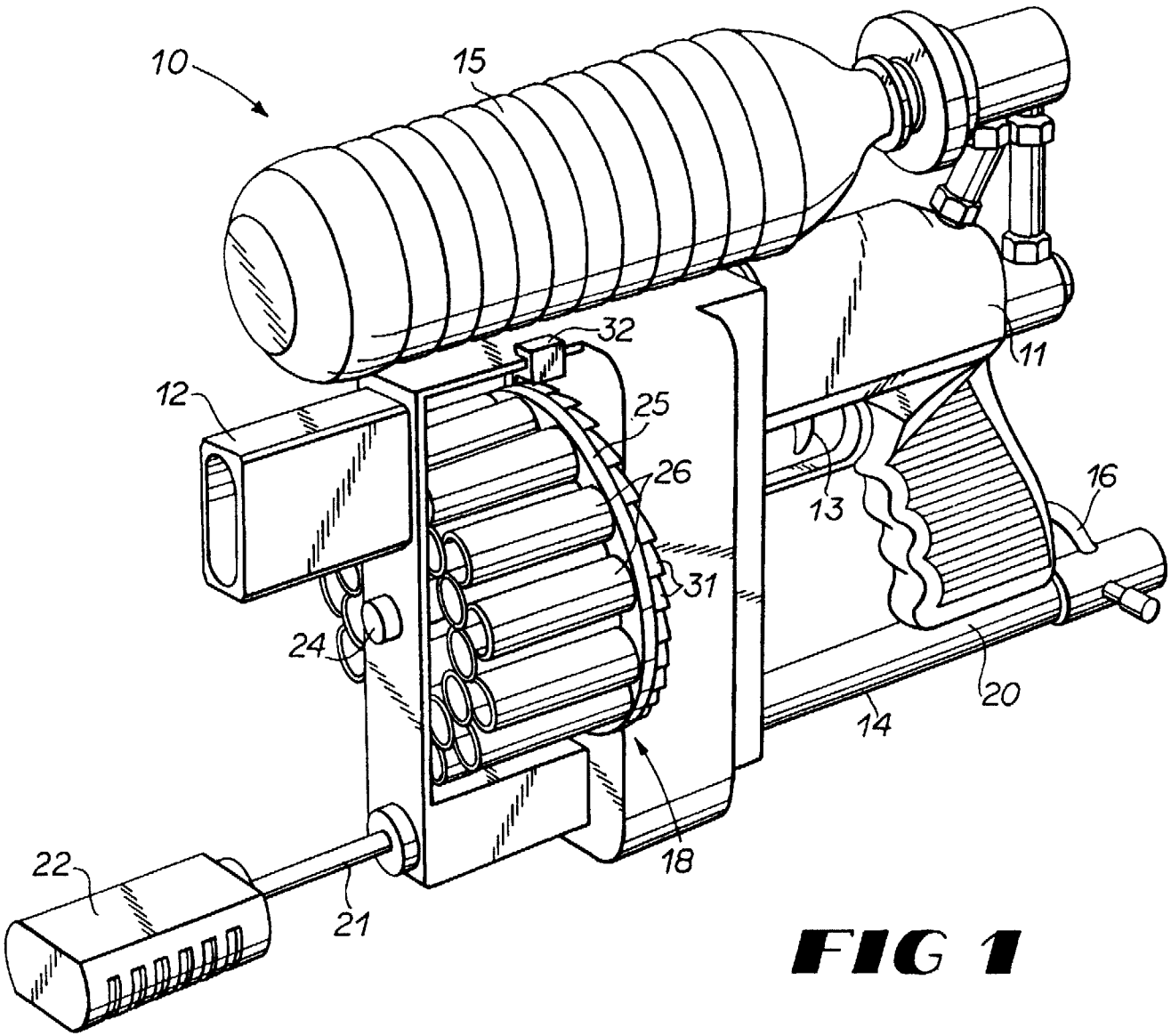
FIG. 1 is a perspective view of a rapid fire compressed air gun embodying principles of the present invention in a preferred form.

With reference next to the drawings, there is shown a compressed air gun 10 having a stock or handle 11, a barrel 12 mounted to the stock 11, a spring biased trigger 13, and a manual air pump 14. The gun 10 has a pressure chamber or tank 15 in fluid communication with the air pump 14 through a pressure tube 16 and a multi-projectile magazine 18 rotationally mounted to stock 11. The pump 14 includes a conventional cylinder 20, a cylinder rod 21 and a handle 22 mounted to an end of the cylinder rod 21.

Figure 3:
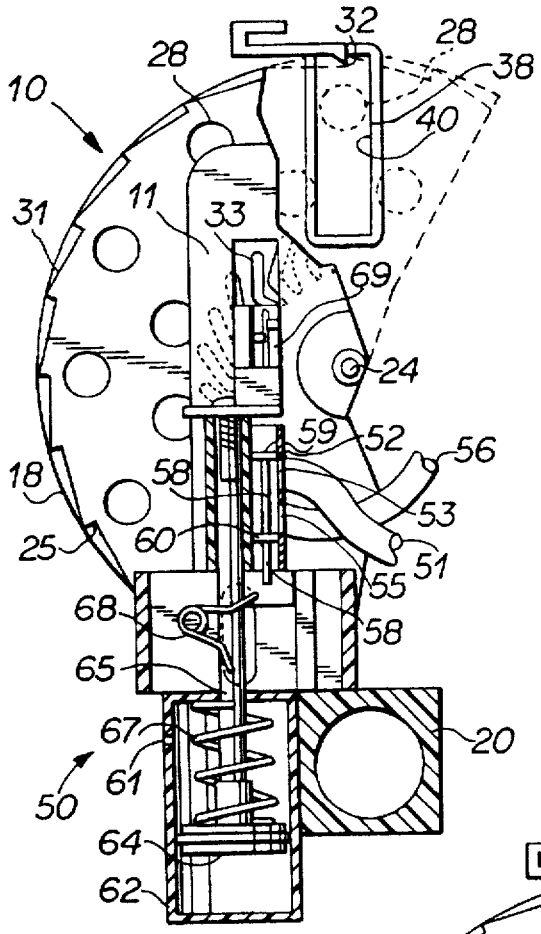
FIGS. 3–5 are a sequence of views showing a portion of the air gun of FIG. 1, which show in sequence, the actuation of an actuator which indexes a magazine and controls a release valve.
Figure 4:
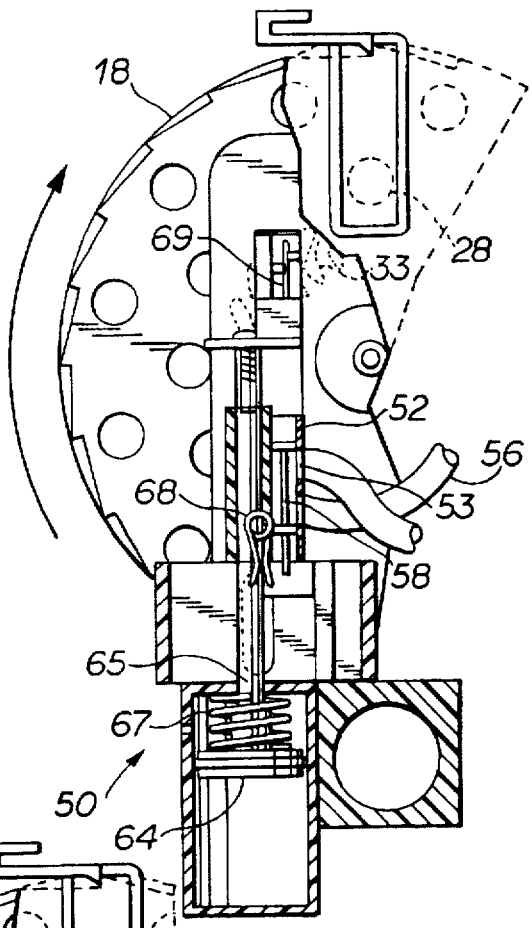
Figure 5:
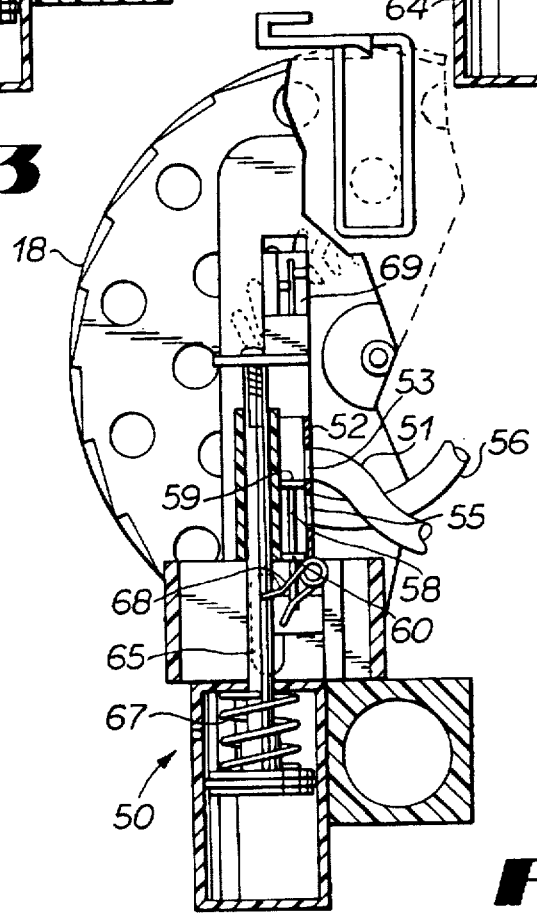
Figure 6:
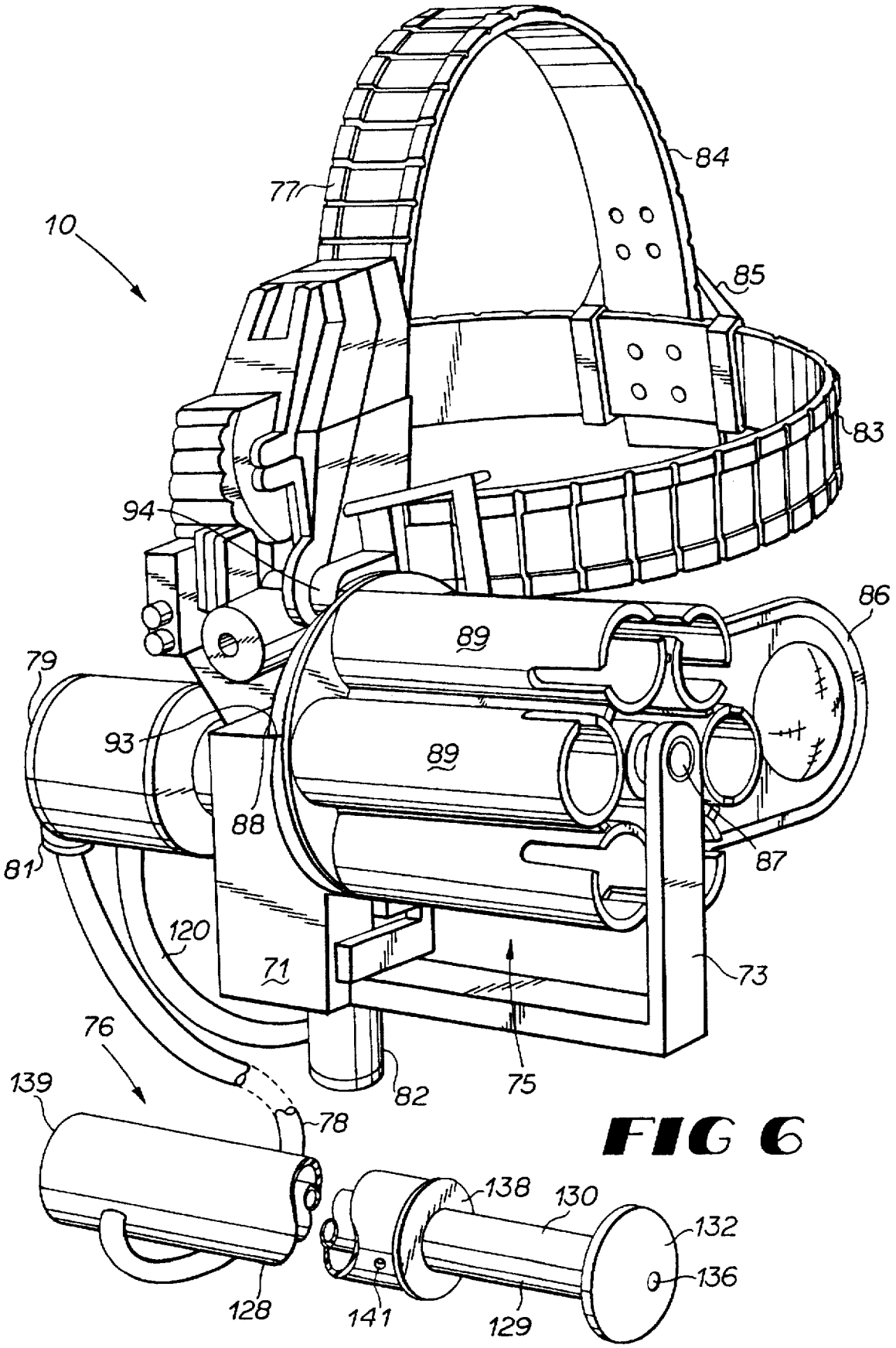
FIG. 6 is a perspective view of a rapid fire compressed air gun embodying principles of the present invention in another preferred form.

The magazine 18 has a central pivot rod 24 mounted to a disk-shaped mounting plate 25 and an annular array of projectile barrels 26 extending from the mounting plate 25 in generally two concentric circles about pivot rod 24. Each barrel 26 has a launch tube 27 therein aligned with an opening 28 extending through the mounting plate 25. Likewise, the openings 29 are oriented in two concentric circles or annular arrays with each opening of the inner circle being positioned generally between two adjacent opening of the outer circle, so as to appear in staggered fashion, as best shown in FIGS. 3–5. Thus, each opening 28' of the outer annular array of openings 28' is aligned along a radius and spaced a selected distance d1 from the center of the mounting plate, and each opening 28" of the inner annular array of openings 28" is aligned along a radius and spaced a selected distance d2 from the center.

Figure 2:
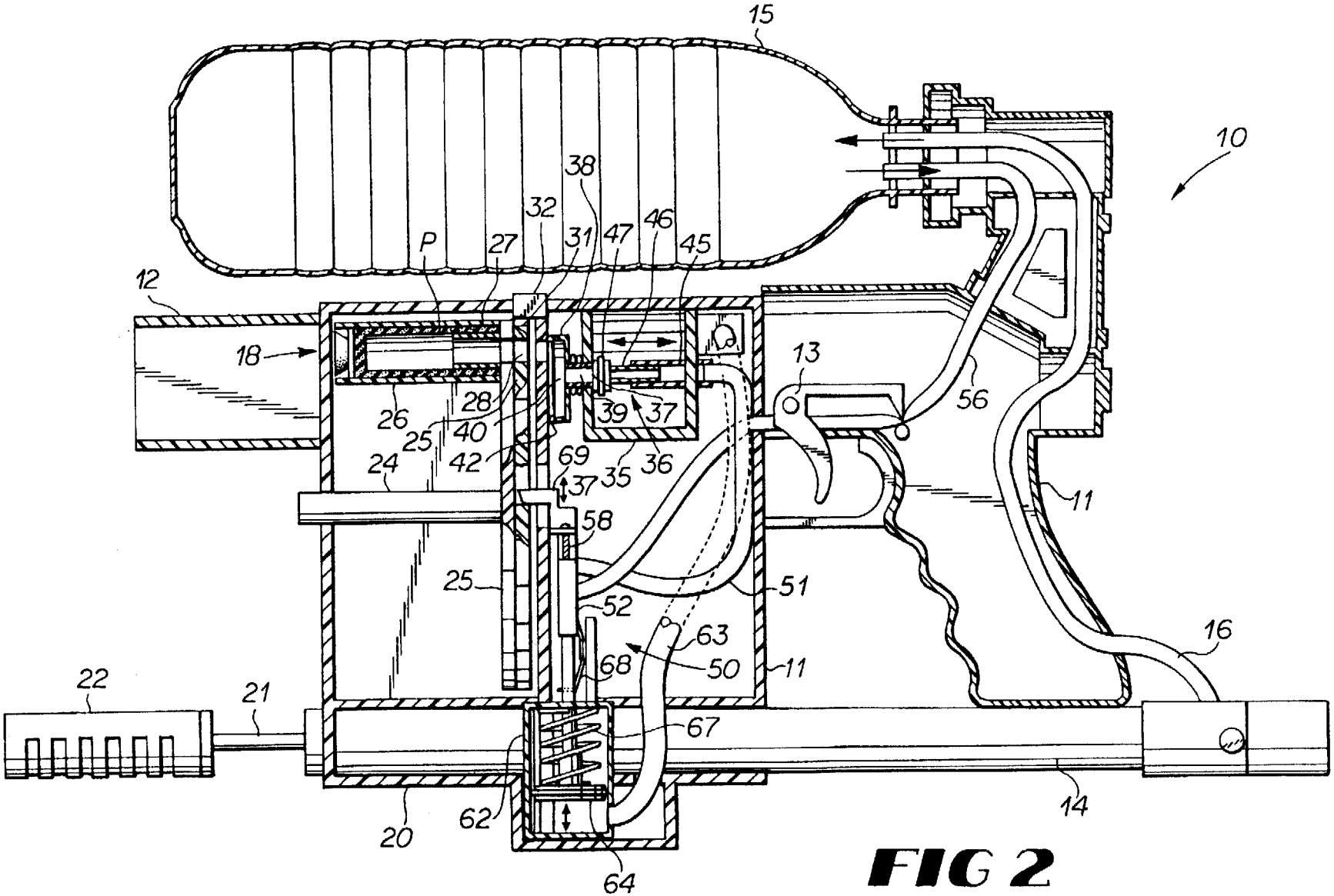
FIG. 2 is a side view, shown in partial cross-section, of the air gun of FIG. 1.

The gun magazine is shown in FIG. 2 as having only one barrel for clarity of explanation. Mounting plate 25 has series of peripheral, outwardly extending, serrated teeth 31 each of which is aligned with a barrel 26. The serrated teeth 31 are configured to cooperate with a pawl 32 extending from the stock 11. The mounting plate 25 also has an annular array of L-shaped grooves 33 equal in number to the number of magazine barrels 26.

The gun 10 has a pressure chamber 35 adapted to receive and store a supply of air at elevated pressure levels and a pressure sensitive release valve 36 mounted within the pressure chamber 35. The pressure chamber 35 has an exit opening 37 therein. A spring biased sealing plate 38 is mounted within opening 37. The sealing plate 38 has a central bore 39 extending into an elongated bore 40 configured to overlay the mounting plate openings 28. It should be noted that the mounting plate openings 28 are positioned so that the sealing plate elongated bore 40 overlaps only one opening 28 at a time. A gasket 42 is mounted to the sealing plate 38 to ensure sealing engagement of the sealing plate with the mounting plate 25. The release valve 36 has a cylindrical manifold 45 and a cylindrical plunger 46 slidably mounted within manifold 45. Plunger 46 has a gasket 47 to ensure sealing engagement of the plunger about opening 37.

The release valve manifold 45 is pneumatically coupled to an actuator 50, by a pressure tube 51 extending therebetween the actuator 50 automatically and sequentially causes the actuation of the release valve 36. Actuator 50 includes an elongated manifold 52 having an upper opening 53 in fluid communication with pressure tube 51 and a lower opening 55 in fluid communication with another pressure tube 56 extending from the pressure tank 15 and positioned so as to be pinchably closed by spring biased trigger 13. A piston 58 is movably mounted within actuator manifold 52. Piston 58 has a top seal 59 and a bottom seal 60. The actuator 50 also has a pressure cylinder 62 having a vent 61 adjacent its top end. Pressure cylinder 62 is coupled in fluid communication with pressure chamber 35 by a pressure tube 63. A piston 64, having an elongated piston rod 65, is mounted within the actuator pressure cylinder 62 for reciprocal movement therein between a low pressure position shown in FIGS. 2 and 3 and a high pressure position shown in FIG. 4. A coil spring 67 mounted about piston rod 65 biases the piston 64 towards its low pressure position. Piston rod 65 is coupled to piston 58 by an over center torsion spring 68, such as that made by Barnes Group Incorporated of Corry, Pa. under model number T038180218-R. An indexing finger 69, mounted to an end of the piston rod 65, is configured to sequentially engage and ride within each magazine L-shaped groove 33.

In use, an operator actuates the pump to pressurize a supply of air by grasping the handle 22 and reciprocating the cylinder rod 21 back and forth within the cylinder 20. Pressurized air is passed through pressure tube 16 into the pressure tank 15. Manual actuation of the trigger 13 moves the trigger to a position wherein it unpinches pressure tube 56 so as to allow pressurized air within the pressure tank 15 to pass through pressure tube 56 into actuator manifold 52 between the top and bottom seals 59 and 60. The pressurized air then passes out of lower opening 55 and through pressure tube 51 into release valve manifold 45.

The pressurized air within the release valve manifold 45 causes the plunger 46 to move to a forward position sealing the opening 37. Pressurized air then flows between the plunger 46 and the release valve manifold 45 so as to pressurize the pressure chamber 35. A portion of the pressurized air within pressure chamber 35 passes through pressure tube 63 into the actuator pressure cylinder 62. With increased pressure within pressure cylinder 62 the piston 64 is forced upwards against the biasing force of coil spring 67, i.e. the piston 64 is moved from its low pressure position shown in FIG. 3 to its high pressure position shown in FIG. 4. As shown in FIG. 4, upward movement of the piston rod 65 causes compression of torsion spring 68 and the finger 69 to ride up within a mounting plate groove 33 thereby causing clockwise rotation of the magazine 18 which brings opening 28" into fluid communication with seal plate 38. All references herein to downward and upward directions is for purposes of clarity in reference to the drawings and is not meant to indicate gravity sensitivity. Upon reaching the apex of the movement of piston rod 65 the torsion spring 68 decompresses thereby forcing piston 58 downward, as shown in FIG. 5. Downward movement of piston 58 causes the top seal 59 to be positioned between upper opening 53 and lower opening 55. This positioning of the piston 58 isolates manifold lower opening 55 to prevent escape of pressurized air from pressure tank 15. This positioning of the top seal 59 also allows pressurized air within pressure tube 51 to escape to ambience through the top of actuator manifold 52. The release of air pressure causes the plunger 46 to move to a rearward position unsealing opening 37. With the unsealing of opening 37 pressurized air within pressure chamber 35 flows through opening 37, into the central and elongated bores 39 and 40 of sealing plate 38, and into the launch tube 27 through mounting plate opening 28. Pressurized air within launch tube 27 propels the projectile out of the magazine barrel 26 and through gun barrel 12. The actuation of this type of release valve is described in more detail in U.S. Pat. No. 4,159,705.

Upon the release of pressurized air from pressure chamber 35 the pressurized air within pressure cylinder 62 is released through pressure tube 63 back into pressure chamber 35. The release of air from pressure cylinder 62 causes the piston 64 be spring biased by coil spring 67 back downward to its low pressure position. The downward movement of piston 64 retracts the indexing finger 69 from within a mounting plate groove 33 and positions the finger in register with the following mounting plate groove 33. The low pressure positioning of piston 64 causes the torsion spring 68 to bias piston 58 upwards to its initial position with the top and bottom seals 59 and 60 straddling upper and lower openings 53 and 55, as shown in FIG. 3. This repositioning of piston 58 once again causes pressurized air within pressure tank 15 to flow through pressure tube 56 into actuator manifold 52, thereby completing a firing cycle. The firing and indexing cycle just describe may continue in rapid sequence so long as the trigger is maintained in a position allowing the flow of pressurized air through pressure tube 56 and the pressure tank continues to contains a minimal level of pressurized air sufficient to overcome the biasing force of springs 67 and 68, i.e. the release valve is automatically actuated by actuator 50 and the indexing of magazine 18 continues so long as the trigger is pulled open and the pressure tank contains pressurized air above a level to overcome springs 67 and 68. Should the pressure level within pressure tank 15 reach the minimal level the operator simply actuates the manual air pump 14 so as to once again elevate the pressure within the pressure tank.

As described, the gun may be used in a fully automatic manner such that with the trigger maintained in a pulled back, actuated position the gun fires a series of projectiles without stopping between each successive shot, similar to the action of a machine gun. However, should an operator wish to fire a single projectile, one need only to pull the trigger and quickly release it so that pressurized air does not continue to flow into the actuator 50. Operated in such a manner the gun will index the magazine and fire a projectile with each actuation of the trigger, again, so long as the pressure tank contains air pressurized above the minimal level and the trigger is quickly released.

It should be noted that pawl 32 engages teeth 31 to prevent rotation of the magazine in a direction opposite to its indexing direction, i.e. to prevent counterclockwise rotation in FIG. 3. This prevents the firing of pressurized air into a just emptied barrel and damage to the indexing finger. It should also be noted that since the pneumatic system is closed, once the gun is initially pressurized it is maintained under at least the minimal pressure level. Thus, the gun has the capability of firing projectiles in a rapid sequence of shots one after another. Yet, the gun may also fire a sequence of single shots without having to be pumped between each successive shot.

Referring next to FIGS. 6–9, a compressed air gun 70 in another preferred form is shown. Here, the air gun 70 has a housing 71 having a support plate 72 and an L-shaped support arm 73, a magazine 75 rotationally mounted to the housing 71, a remote manual hand air pump 76, and a harness 77 secured to housing 71 and configured to be supported upon the head of a person. The gun 70 has a pressure chamber 79 adapted to receive and store a supply of air at elevated pressure levels and a pressure actuatable release valve 80 mounted within the pressure chamber 79. A control valve 81 is mounted in fluid communication with release valve 80 and is coupled in fluid communication with pump 76 by a pressure tube 78 extending therebetween. Pressure chamber 79 is pneumatically coupled to a pneumatic indexer 82 which in turn is coupled to magazine 75 for rotational movement thereof.

The head harness 77 has a generally circular base strap 83 and a inverted U-shaped, adjustable top strap 84 secured to the base strap 83 by a buckle 85. The head harness 77 also has a clear eye sight 86 configured to be positioned over the eye of a person. The top strap 84 and base strap 83 may be made of a soft, flexible plastic which can conform to the person's head.

Figure 9:
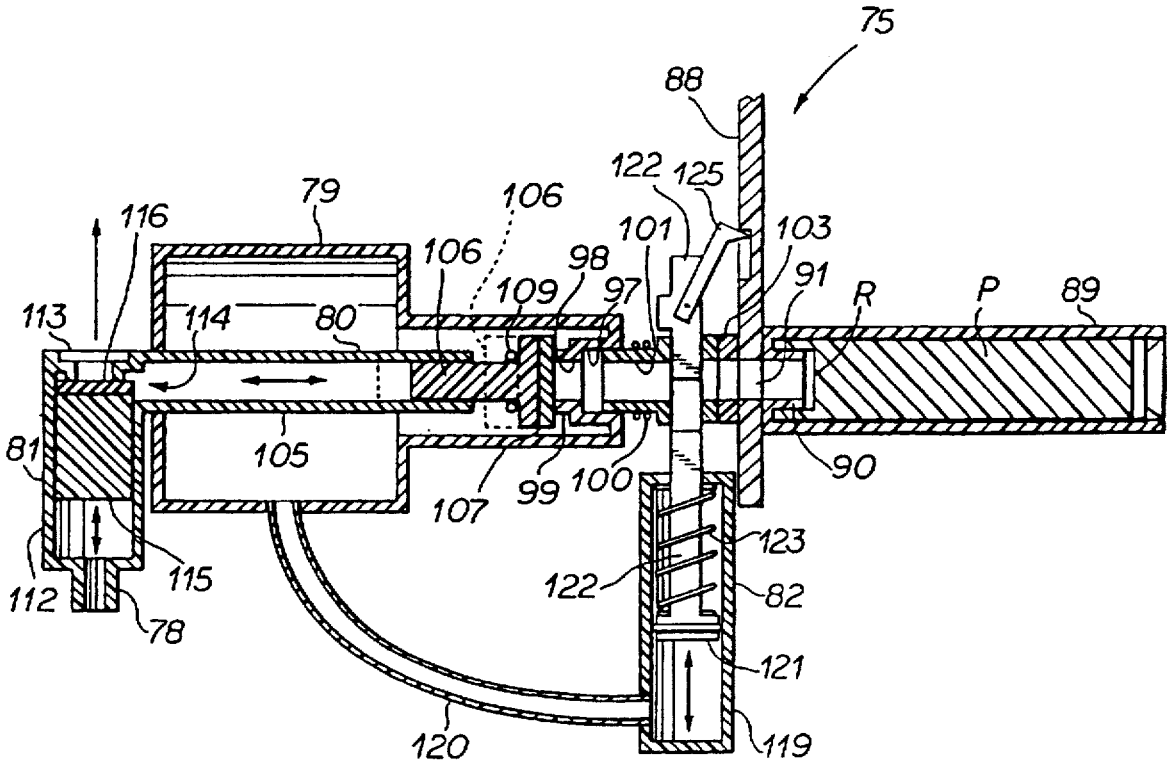
FIG. 9 is a side view, shown in partial cross-section, of interior components of the air gun of FIG. 6 and a projectile positioned within the barrel of the gun.

The magazine 75 has a central pivot rod 87 fixedly mounted to a disk-shaped mounting plate 88 and an annular array of projectile barrels or launch tubes 89 extending from the mounting plate 88 in a generally concentric circle about pivot rod 87. Pivot rod 87 is rotationally mounted at one end to support arm 73 and rotationally mounted at its opposite end to support plate 72. Each barrel 89 has a launch tube 90 therein aligned with an opening 91 which extends through the mounting plate 88. The interior diameter of barrel 89 is configured to releasably hold a projectile P with the launch tube 90 configured to be received within a recess R in the rear of the projectile. The magazine is shown in FIG. 9 as having only one barrel 89 for clarity of explanation. Mounting plate 88 has series of peripheral notches 93 each of which is aligned with a barrel 89. The notches 93 are configured to cooperate with a pawl 94 extending from the housing 71. Mounting plate 88 also has an annular array of L-shaped grooves 95 oriented about pivot rod 87 which are equal in number to the number of magazine barrels 89.

The pressure chamber 79 has a recess 97 having an air exit opening 98 therein defined by an inwardly extending annular flange 99. A spring biased sealing plate 100 is mounted within recess 97. The sealing plate 100 has a central bore 101 configured to overlay the mounting plate openings 91 of the magazine. It should be noted that the mounting plate openings 91 are positioned so that the sealing plate bore 101 overlaps only one opening 91 at a time. A gasket 103 is mounted to the sealing plate 100 to ensure sealing engagement with the mounting plate 88. The release valve 80 has a cylindrical manifold 105 and a cylindrical plunger 106 slidably mounted within the manifold 105. Plunger 106 has a gasket 107 to ensure sealing engagement of the plunger 106 about opening 98 with the plunger in a sealing position shown in FIG. 9, and a O-ring type seal 109 to ensure sealing engagement of the plunger 106 against manifold flange 99 with the plunger in a released position shown in phantom lines in FIG. 9.

The control valve 81 has an elongated cylindrical manifold 112 having a top vent opening 113 to ambience, a side opening 114 in fluid communication with release valve manifold 105, and a cylindrical plunger 115 slidably mounted within manifold 112. Plunger 115 has a gasket 116 to ensure sealing engagement of the plunger about vent opening 113 with the plunger in a pressurized position shown in FIGS. 7 and 9.

The indexer 82 has a pressure cylinder 119 coupled in fluid communication with pressure chamber 79 by a pressure tube 120. A piston 121, having an elongated piston rod 122, is mounted within the indexer pressure cylinder 119 for reciprocal movement therein between a low pressure position shown in FIG. 8 and a high pressure position shown in FIGS. 7 and 9. A coil spring 123 is mounted about piston rod 122 so as to bias the piston 121 towards its low pressure position. A spring biased indexing finger 125 is pivotably mounted to piston rod 125. Indexing finger 125 is configured to sequentially engage and ride within each magazine groove 95 as the piston rod is moved upward and to disengage the groove as the piston rod is moved downward. All references herein to downward and upward directions is for purposes of clarity in reference to the drawings and is not meant to indicate gravity sensitivity.

The air pump 76 includes an elongated cylinder 128 and a plunger 129 telescopically mounted for reciprocal movement within the cylinder 128. Plunger 129 has a tubular shaft 130 with an enlarged sealing end 131 and a handle 132 opposite the sealing end 131. Sealing end 131 has an O-ring type seal 133 with an opening 134 therethrough, and a conventional check valve 135 mounted within opening 134. Check valve 135 is oriented to allow air to pass from the interior of cylinder 128 through opening 134 into the interior of shaft 130 and to prevent air from passing through opening 134 in the opposite direction. Handle 132 has a vent 136 therethrough which allows air to pass from ambience into the interior of shaft 130.

Pump cylinder 128 has an open end 138 through which plunger 129 extends and a closed end 139. The pump cylinder 128 also has a port 140 in fluid communication with pressure tube 78 and a vent 141 adjacent open end 138 which is open to ambience. Port 140 is spaced from closed end 139 so as to allow seal 133 of plunger 129 to be moved past the port 140 to a position closely adjacent to the closed end 139, as shown in FIG. 8.

In use, a person dons the gun by securing the head harness 77 to his head with the magazine 75 to one side. The person then actuates the pump 76 by grasping the pump handle 132 and forcing the pump plunger 129 through cylinder 128 towards port 140 thereby pressurizing air within the cylinder. Thus, the plunger 129 is moved from a first position shown in phantom lines in FIG. 7 to generally a second position shown in FIG. 7. The pressurized air passes through port 140 into pressure tube 78 where it then passes through control valve 81. The increase in air pressure within the control valve manifold 112 forces the control valve plunger 115 to move to an upper, pressurized position sealing vent opening 113, as shown in FIG. 9. The pressurized air then passes about plunger 115 and through side opening 114 into the release valve manifold 105. The increase in air pressure within the release valve manifold 105 forces the control valve plunger 106 to move to a forward, pressurized position sealing opening 98, as shown in FIG. 9. The pressurized air then flows between the release valve plunger 106 and the release valve manifold 105 into pressure chamber 79.

A portion of the pressurized air within pressure chamber 79 passes through pressure tube 120 into the indexer pressure cylinder 119. With increased pressure within pressure cylinder 119 the indexer piston 121 is forced upwards against the biasing force of coil spring 123, i.e. the indexer piston 121 is moved from its low pressure position shown in FIG. 8 to its high pressure position shown in FIGS. 7 and 9. As shown in FIG. 9, upward movement of the piston rod 122 causes the finger 125 to ride up within a mounting plate groove 95 to cause counter-clockwise rotation of the magazine 75 as indicated by arrows in FIGS. 7 and 8.

Figure 8:
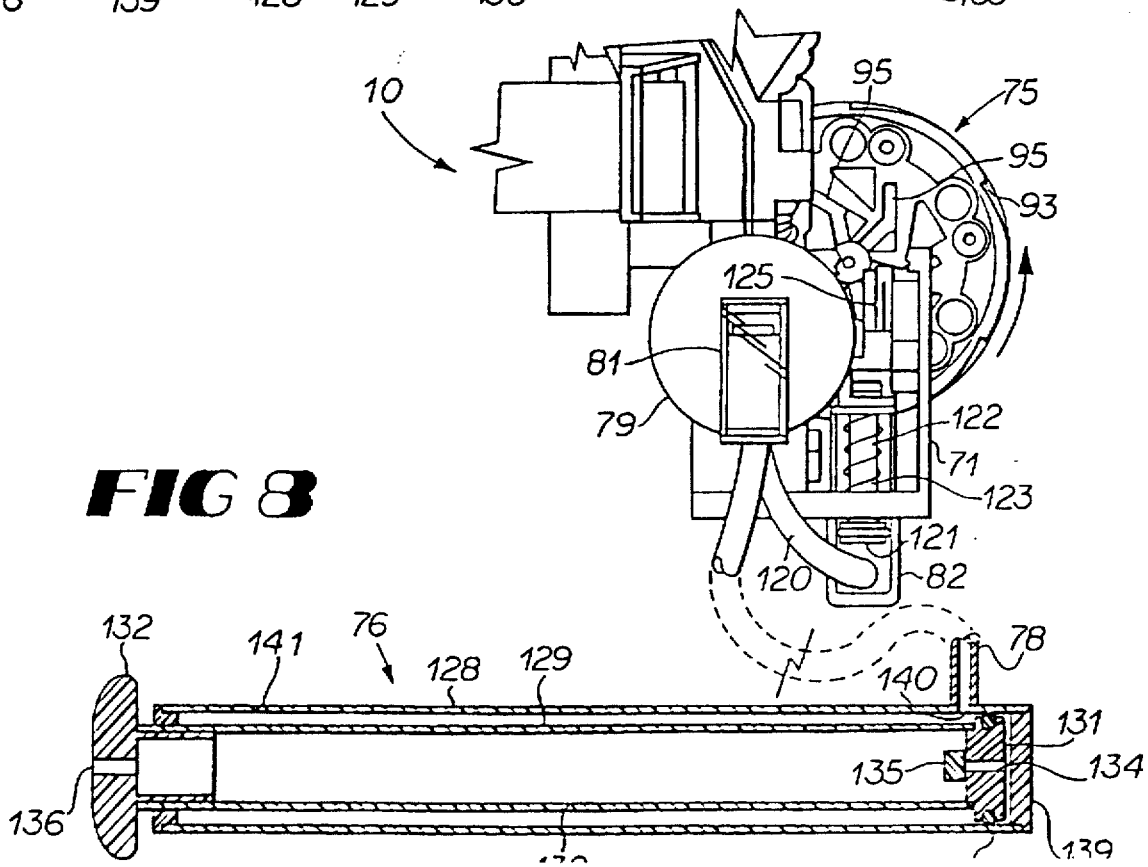
FIG. 8 is a rear view of portions of the air gun of FIG. 6 with the pump shown in side view for clarity of explanation.

With continued movement of the pump plunger 129 within pump cylinder 128 the seal 133 passes pump cylinder port 140, as shown in FIG. 8. With the plunger seal 133 in this position pressurized air within pressure tube 78 is released back into pump cylinder 128 behind seal 133 and then to ambience through vent 141. The reentry of pressurized air into the pump cylinder 128 from pressure tube 78 causes the control valve plunger 115 to move to a downward position unsealing vent opening 113, as shown in FIG. 8. Thus, the decrease in air pressure within the pressure tube 78 and control valve manifold 112 triggers the actuation of control valve 81 to its open configuration. The actuation of the control valve to its open, downward position causes a release of pressurized air from within release valve manifold 105 through the control valve side opening 113 and then through vent opening 113 to ambience. This decrease in pressure causes release valve plunger 106 to move to a rearward position unsealing opening 98, as shown in phantom lines in FIG. 9. The position of the plunger 106 also causes and the O-ring to abut manifold 105 to seal the path between the manifold 105 and plunger 106. With the unsealing of opening 98 pressurized air within pressure chamber 79 rapidly flows through opening 98, through sealing plate bore 101, through magazine mounting plate opening 91, and into launch tube 90 in register with the sealing plate 100 where it propels the projectile P from barrel 89. Operation of this type of release valve is described in more detail in U.S. Pat. No. 4,159,705.

Upon the release of pressurized air from pressure chamber 79 the pressurized air within indexer pressure cylinder 119 is conveyed through pressure tube 120 back into pressure chamber 79. This release of pressurized air from indexer pressure cylinder 119 causes the indexer piston 121 to be spring biased by coil spring 123 back downward to its low pressure position. The downward movement of piston 121 pivotally retracts the indexing finger 125 from mounting plate groove 95 and positions the finger in register with the following mounting plate groove.

The pump plunger 129 may then be manually drawn back to its initial position to pressurize and fire the gun again. The drawing back of the pump plunger 129 does not create a vacuum within pump cylinder 128 since replenishment air may be drawn through vent 136 into the plunger handle 132, through the interior of shaft 130, and through check valve 135 into cylinder 128. Air between the pump cylinder 128 and the plunger 129 behind seal 134 is expelled from cylinder 128 through vent 141.

Figure 7:
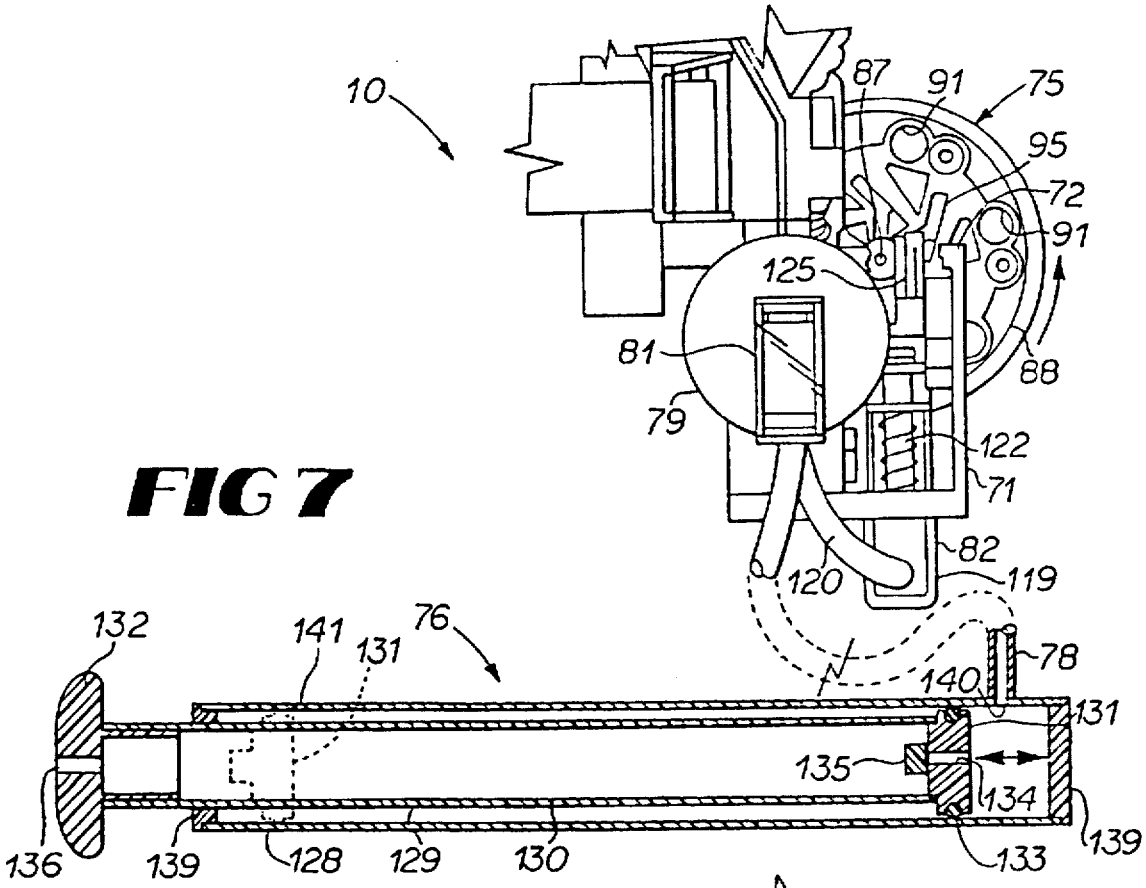
FIG. 7 is a rear view of portions of the air gun of FIG. 6 with the pump shown in side view for clarity of explanation.

It should be noted that pawl 94 engages notches 93 to prevent rotation of the magazine 75 in a direction opposite to its indexing direction, i.e. to prevent clockwise rotation of the magazine with reference to FIGS. 7 and 8. This prevents the firing of pressurized air into a previously emptied barrel and damage to the indexing finger 125.

As an alternative, gun 70 may also be constructed without control valve 81. The need for the control valve is dependent upon the length and interior diameter of pressure tube 78, i.e. the volume of air contained within the pressure tube. For a pressure tube 78 having a small interior volume the release of air therefrom causes rapid actuation of release valve 80. Conversely, with a pressure tube 78 containing a large volume of air therein the release of air therefrom may be inadequate to actuate the release valve properly. Thus, with pressure tubes having a large volume therein a control valve 81 is coupled to the release valve 80 to ensure rapid decompression within release valve manifold 105 to actuate the release valve. The gun may also be constructed without the inner launch tube 90 within the barrel 89. Here, the pressurized air expelled from pressure chamber 79 is directed into barrel 89 behind the projectile. This design however is not preferred as it does not concentrate the burst of pressurized air for optimal efficiency and performance. Lastly, it should be understood that the magazine and indexer of FIGS. 6–9 may also be adapted to a hand held gun of conventional design.

It should be understood that the gun of FIGS. 6–9 may also be adapted to include the two concentric circle arrangement of the opening, as shown in FIGS. 1–5, to increase the projectile capacity of the magazine.

With the air gun of this construction a child may aim the gun simply by facing the intended target and manually actuating the hand pump. Because of the elongated, flexible pressure tube 78 the pump may be manipulated substantially independently of and without effecting the air of the launch tube. Thus, the gun is of an unconventional design to interest children yet is capable of being easily aimed and fired. Also, the child may fire several shots sequentially without having to reload between each successive shot.

Figure 10:
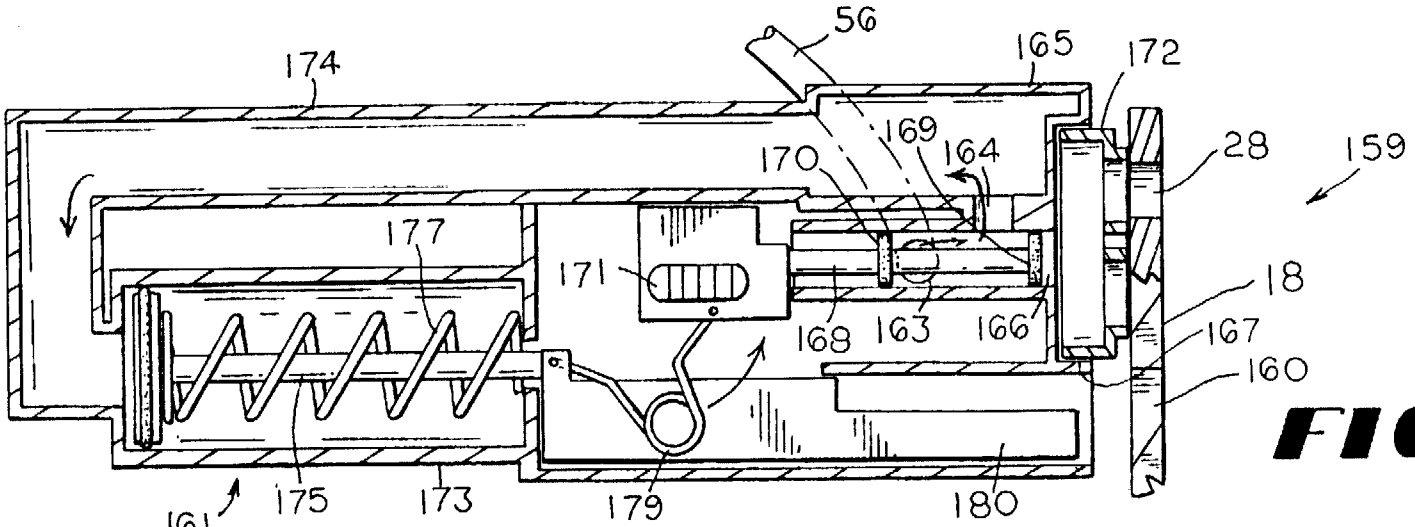
FIG. 10 is a side view, shown in partial cross-section, of an alternative design for the interior components of the air gun of FIG. 1, shown in a pressurizing configuration.
Figure 11:
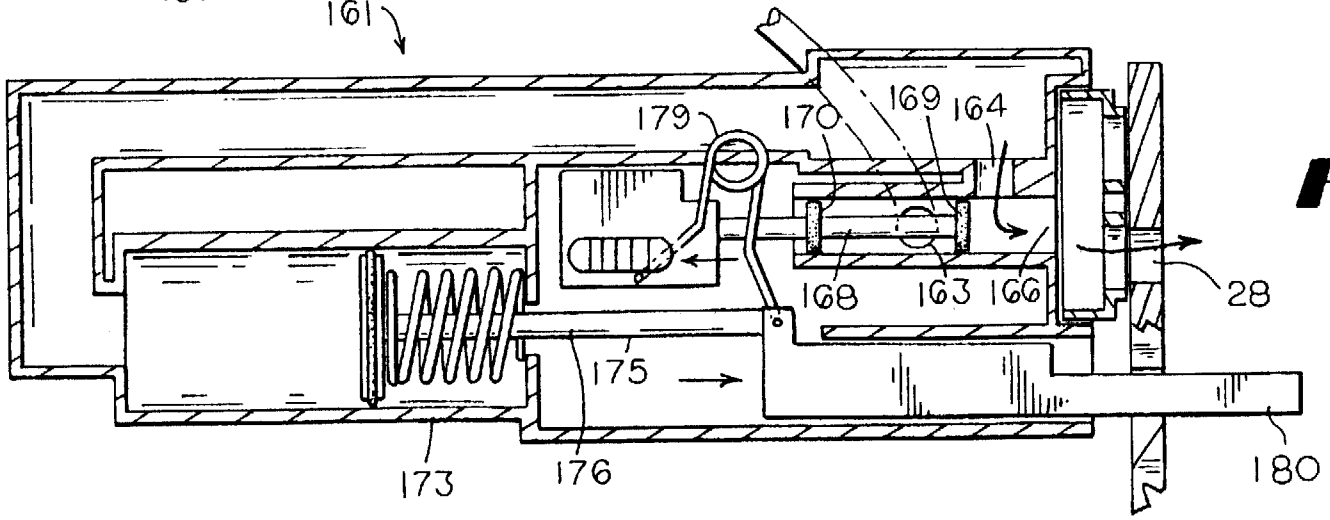
FIG. 11 is a side view, shown in partial cross-section, of the interior components shown in FIG. 10, shown in a firing configuration.

With reference next to FIGS. 10 and 11, a compressed air gun 159 in another preferred form is shown. Here, the air gun 159 is similar in basic construction to that shown in FIGS. 1–5, except for the internal components for the sequential firing of pressurized air bursts and pneumatic indexing of the magazine, and the magazine grooves 160 are angled rather than being L-shaped. For this reason, only the new, alternative components of the air gun are shown for clarity and conciseness of explanation.

The air gun 159 has a pneumatic firing actuator 161 coupled to the pressure tank through pressure tube 56. Actuator 161 includes an elongated manifold 162 having an inlet opening 163 in fluid communication with pressure tube 56, an outlet opening 164 in fluid communication with a small pressure tank or pressure cell 165, and an open end or firing opening 166 in fluid communication with an elongated recess 167. A piston 168 is mounted for reciprocal movement within actuator manifold 162. Piston 168 has a forward seal 169, a rearward seal 170 and a clear button 171 extending through the air gun housing. The actuator 161 also has a flexible gasket 172 mounted within recess 167 in sealable contact with magazine 18, and a pressure cylinder 173 in fluid communication with pressure cell 165 by a conduit 174. A piston 175, having an elongated piston rod 176, is mounted within the actuator pressure cylinder 173 for reciprocal movement therein between a low pressure, pressurizing position shown in FIG. 10 and a high pressure, firing position shown in FIG. 11. A coil spring 177 mounted about piston rod 176 biases the piston 175 towards its low pressure position. Piston rod 176 is coupled to piston 168 by an over center torsion spring 179. An indexing finger 180, mounted to an end of the piston rod 176, is configured to sequentially engage and ride within each magazine groove 160 for sequential rotation of the magazine.

In use, an operator actuates the pump to pressurize a supply of air by grasping the handle 22 and reciprocating the cylinder rod 21 back and forth within the cylinder 20. With piston 168 in its rearward pressurized air is passed through pressure tube 16 into the pressure tank 15. Manual actuation of the trigger 13 moves the trigger to a position wherein it unpinches pressure tube 56 so as to allow pressurized air within the pressure tank 15 to pass through pressure tube 56 into actuator manifold 162 through inlet opening 163 and between the forward and rearward seals 169 and 170 of piston 168. The pressurized air then passes out of manifold 162 through outlet opening 164 and into pressure cell 165, conduit 174, and pressure cylinder 173.

The pressurized air within the pressure cylinder 173 causes piston 175 to move toward its high pressure position against the biasing force of coil spring 177, i.e. the piston 175 is moved from its low pressure position shown in FIG. 10 to its high pressure position shown in FIG. 11.

As shown in FIG. 11, forward movement of the piston 175 causes compression and rotation of torsion spring 179 and the indexing finger 180 to move forward into a magazine groove 160, thereby causing rotation of the magazine 18 and alignment of the opening to change to the inner circle of openings 28". All references herein to forward and rearward is for purposes of clarity in reference to the drawings. Upon reaching the apex of the movement of piston rod 176 the torsion spring 179 reaches a rotated position which causes decompression of the spring thereby forcing piston 168 rearward, as shown in FIG. 11. Rearward movement of piston 168 causes the forward seal 169 to be moved to a positioned between inlet opening 163 and the outlet opening 164. This positioning of the piston 168 isolates manifold inlet opening 163 to prevent escape of pressurized air from pressure tank 15, i.e. the seals sandwich the inlet opening to prevent the flow of air from the pressure tank. This positioning of the forward seal 169 also allows pressurized air within the pressure cell 165, conduit 174 and pressure cylinder 173 to flow through outlet opening 164 into the manifold and from the manifold through firing opening 166, through sealed recess 167 and into the launch tube 27 through magazine opening 28'. Pressurized air within launch tube 27 propels the projectile out of the magazine barrel 26 and through gun barrel 12.

The release of pressurized air from pressure cylinder 173 causes the piston 175 to be spring biased by coil spring 177 back rearward to its low pressure position. The rearward movement of piston 175 retracts the indexing finger 180 from within a mounting plate groove 160 and positions the finger in register with the following mounting plate groove 160. The low pressure positioning of piston 175 causes the torsion spring 179 to bias piston 168 forwards to its initial position with the forward and rearward seals 169 and 170 sandwiching or straddling inlet and outlet openings 163 and 164, as shown in FIG. 10. This repositioning of piston 168 once again causes pressurized air within pressure tank 15 to flow through pressure tube 56 into actuator manifold 162, thereby completing a firing cycle. The firing and indexing cycle just describe may continue in rapid sequence so long as the trigger is maintained in a position allowing the flow of pressurized air through pressure tube 56 and the pressure tank continues to contains a minimal level of pressurized air sufficient to overcome the biasing force of springs 177 and 179, i.e. the release valve is automatically actuated by actuator 161 and the indexing of magazine 18 continues so long as the trigger is pulled open and the pressure tank contains pressurized air above a level to overcome springs 177 and 179. Should the pressure level within pressure tank 15 reach the minimal level the operator simply actuates the manual air pump 14 so as to once again elevate the pressure within the pressure tank.

As described, the gun may be used in a fully automatic manner such that with the trigger maintained in a pulled back, actuated position the gun fires a series of projectiles without stopping between each successive shot, similar to the action of a machine gun. However, should an operator wish to fire a single projectile, one need only to pull the trigger and quickly release it so that pressurized air does not continue to flow into the actuator 161. Operated in such a manner the gun will index the magazine and fire a projectile with each actuation of the trigger, again, so long as the pressure tank contains air pressurized above the minimal level and the trigger is quickly released.

It should be understood that at times rubber seals often stick when stored for a period of time. This sticking may hamper the performance of the actuator. For this reason, the actuator is provided with clear button 171 which may be manually actuated to cause reciprocal movement of the piston in order to unstick the seals.

With reference next to FIGS. 12 through 15, there is shown a combination outer barrel 200 and inner launch or projectile mounting tube 201 mounted longitudinally and concentrically within barrel 200. This combination is another preferred form which may replace the previously shown launch tube, with other aspects of the gun remaining the same. A foam projectile P, having a tail bore 203 extending from its tail end 204, is removably mounted upon the mounting tube 201 and within the barrel 200. The tail bore 203 terminates at a bore end wall 206.

Mounting tube 201 has an air entry end 209 and a tapered air exit end 210. The air exit end 210 has a laterally extending safety bar 211 which in combination with the exit end 210 defines two oppositely disposed air exit openings 212. The external configuration or surfaces of the mounting tube 201 is such that with the mounting tube extending into the projectile bore for launching a space or channel 214 is formed between the mounting tube and the projectile, i.e. the external configuration or surfaces of the launch tube as compared with the internal configuration of the projectile tail bore creates an air passage from the mounting tube exit openings to the tail of the projectile. Also, the projectile external configuration or surfaces are substantially the same as the interior configuration or surfaces of the barrel. For example, with a cylindrical projectile the internal diameter of the tail bore is greater, at least in some areas thereof, than the external diameter of the mounting tube and the external diameter of the projectile is substantially equal to the internal diameter of the barrel.

Barrel 200 has a projectile exit end 216 which extends past the air exit end 210 of the mounting tube. The barrel has a pair of oppositely disposed elongated slots 217 which extend from the exit end 216 of the barrel to a position at least generally level or even with the air exit end 210 of the mounting tube, i.e. the slat may extend past the level of the air exit end of the mounting tube towards the closed end of the barrel but not above the level of the air exit end.

In use, the compressed air passing through the mounting tube air exit openings 212 is received within the space between mounting tube and the projectile bore end wall 206. A portion of the compressed air then passes through channel 214 to a position below the projectile tail end 204. This is a vast improvement over the prior art darts or projectiles wherein the projectile fit snugly against the mounting tube. For with these prior art projectiles the compressed air was maintained in an area between the mounting tube and the tail bore end wall. As such the compressed air moves the projectile by placing a force upon the tail bore end wall in a direction which allows the projectile to move forward. This force is equal to the pressure multiplied by the area of the bore end wall. With the projectile embodying the present invention, the force of the compressed air is placed not only upon the bore end wall 206 but also upon the tail end 204 of the projectile. Hence, the force is equal to the pressure multiplied by the area of the bore end wall plus the pressure multiplied by the surface area of the projectile tail end. The increased launching force provide by the force upon the projectile tail results in an increased projectile velocity, which in turn also increases the accuracy of the launched projectile.

The compressed air pressure within channel 214 also forces the projectile, which is typically made of foam rubber and therefore resilient, to expand against the interior walls of the barrel. This expansion of the projectile results in a tighter seal between the projectile and the barrel.

It should be understood that the tapering of the exit end of the mounting tube increases the area of the air exit openings 212 as compared with conventional, blunt ended mounting tube, i.e. the area of the two elliptical openings is greater than conventional circular opening of the prior art tubes. This increase in opening area compensates for the blockage or reduction of the opening area as a result of the safety bar 211 extending across the air exit end of the mounting tube.

Figure 14:
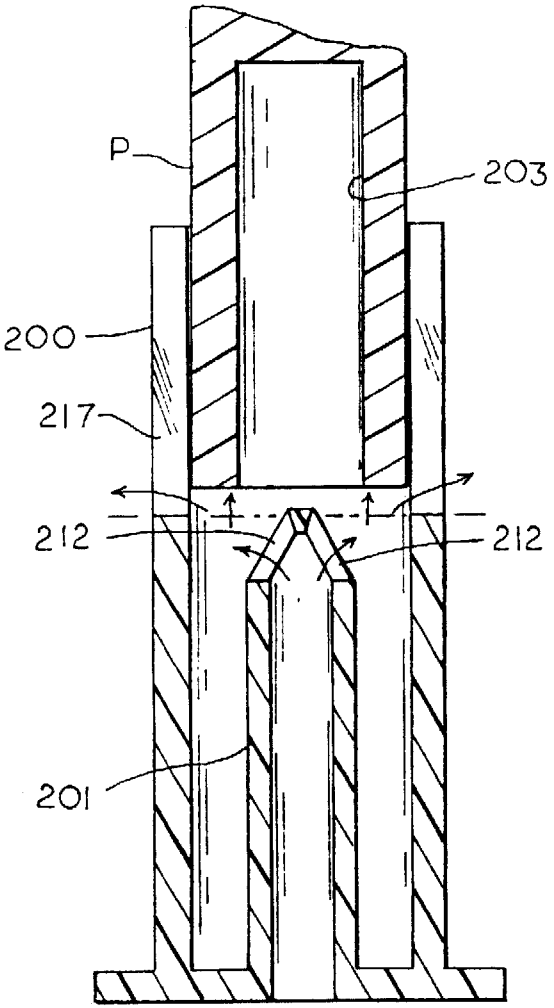
FIG. 14 is a side view, shown in partial cross-section, of the mounting tube and barrel of FIG. 12, shown with the projectile being launched.
Figure 13:
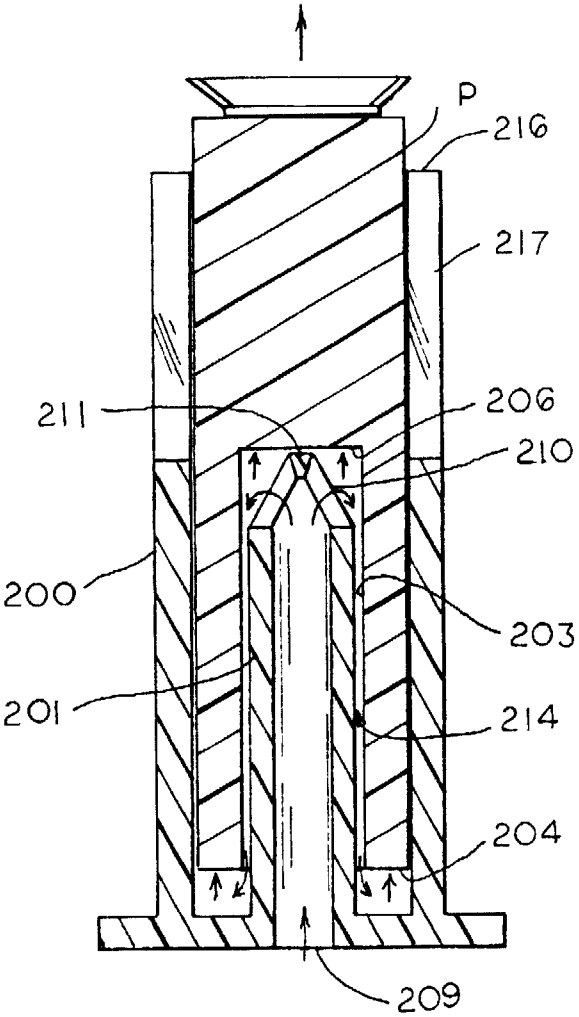
FIG. 13 is a side view, shown in partial cross-section, of the mounting tube and barrel of FIG. 12, shown with the projectile initially being launch.

The slots 217 within the barrel aid in maintaining the projectile in a straight alignment as it exits the barrel. This is accomplished by venting the compressed air from behind the projectile prior to it exiting the barrel, as best shown in FIG. 14. Thus, the projectile is maintained in a straight alignment through the end portion of the barrel and subsequent to the force created by the compressed air. As such, the compressed air will not cause the projectile to skew or tumble because of an uneven distribution of air upon the tail the instant it exits the barrel.

Figure 15:
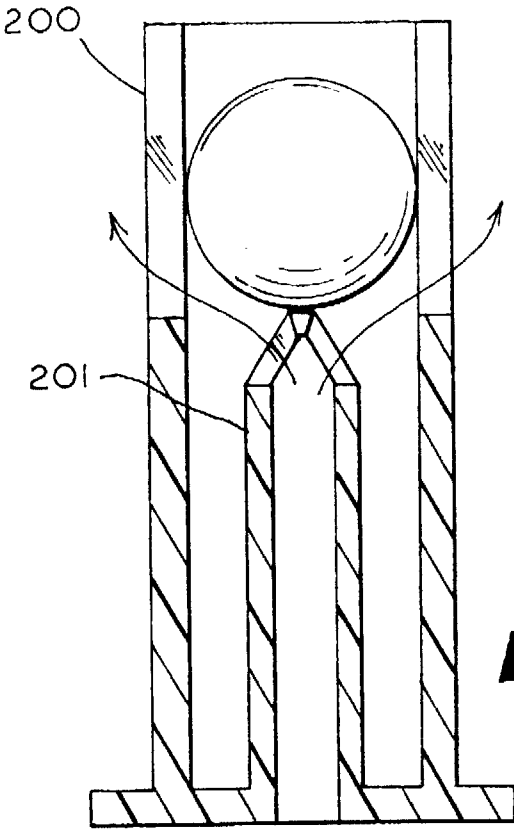
FIG. 15 is a side view, shown in partial cross-section, of the mounting tube and barrel of FIG. 12, shown with a foreign object positioned within the barrel.
Figure 12:
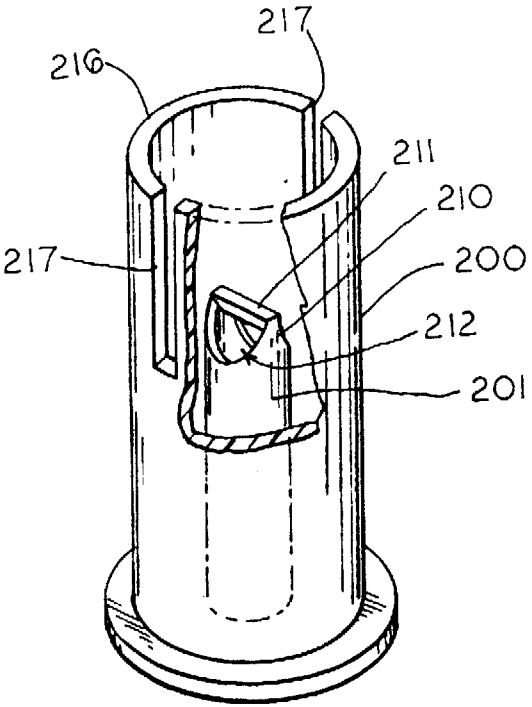
FIG. 12 is a perspective view of the mounting tube and barrel of a compressed air gun in another preferred form.

The slot however also has a safety purpose which prevents the launching of foreign objects, other than the appropriate projectiles, which a child may place into the barrel. Should a foreign object be placed within the barrel to a point where it contacts the air exit end 210 of the mounting tube or prior to this position, the compressed air exiting the mounting tube is vented through the slots, as shown in FIG. 15. As such, the foreign object is not launched or is launched with a minimal velocity. For this reason, the slots preferably extend to a position generally aligned with the air exit end or past the air exit end in a direction towards the tail of the projectile. For if the slots were to terminate before reaching a level even with the air exit end of the mounting tubes an area within the barrel and prior to the foreign object would be created wherein the compressed air would not be vented prior to reaching the foreign object. Additionally, the safety bar 211 prevents a foreign object from being forced into the mounting tube, which may be launched with the release of compressed air. Furthermore, it should be understood that should a foreign object be lodged into one of the air exit openings the compressed air flowing through the mounting tube will be released through the other exit opening. As such, again the foreign object will not be launched or will be launched with a minimal velocity.

It should be understood that the slots 217 may be configured in a variety of different manners and need not be a continuous or longitudinal slot. For example, a longitudinal array of slots will accomplish the same venting capability. However, an elongated longitudinal slot is preferred so as to enable one to reach a foreign object with a probe and slide the probe along the slot while in contact with the foreign object to dislodge it from the barrel. It should also be understood that the application of the just described mounting tube and barrel is not limited to rapid fire compressed air guns but also to single shot or single barrel type compressed air guns. Lastly, it should be understood that projectiles as used herein are not limited to darts but may include other types of projectiles such as rockets, airplanes and the like. Also, the safety bar is not meant to be limited to bars but also to other configurations wherein a portion of the mounting tube partially blocks or obstructs the air exit end.

While this invention has been described in detail with particular reference to the preferred embodiments thereof, it should be understood that many modifications, additions and deletions, in addition to those expressly recited, may be made thereto without departure from the spirit and scope of invention as set forth in the following claims.

We claim:

1. A compressed air toy gun for firing projectiles having a tail bore comprising:

pump means for compressing air;

conduit means in fluid communication with said pump means for conveying compressed air from said pump means; and launch tube means in fluid communication with said conduit means for holding and launching a projectile, said launch tube means having an outer barrel having a projectile exit end and an inner tube mounted longitudinally within and spaced from said outer barrel, said inner tube having an air entry end in fluid communication with said conduit means and an air exit end longitudinally spaced from said barrel projectile exit end, said barrel having vent means extending from adjacent said projectile exit end to a position at least generally level with said tube air exit end.

2. The compressed air toy gun of claim 1 wherein said inner tube has a member partially obstructing said air exit end.

3. The compressed air toy gun of claim 2 wherein said member is a bar extending across said air exit end.

4. The compressed air toy gun of claim 2 wherein said inner tube air exit end tapers outwardly from said member.

5. The compressed air toy gun of claim 4 wherein the projectile is of the type having a cylindrical body with a selected outside diameter and a selected internal tail bore diameter, and wherein said barrel has a selected inside diameter substantially equal to the projectile body outside diameter, and wherein said inner tube has a selected outside diameter less than the projectile tail bore inside diameter so as to form an air channel between said inner tube and said projectile with the inner tube extending into said tail bore for launch.

6. The compressed air toy gun of claim 1 wherein the projectile is of the type having a cylindrical body with a selected outside diameter and a selected internal tail bore diameter, and wherein said barrel has a selected inside diameter substantially equal to the projectile body outside diameter, and wherein said inner tube has a selected outside diameter less than the projectile tail bore inside diameter so as to form an air channel between said inner tube and said projectile with the inner tube extending into said tail bore for launch.

7. A compressed air toy gun for firing projectiles having a forward end, a tail end, a tail bore extending partially into the projectile from the tail end, a selected external configuration and a selected internal configuration, said compressed air toy gun comprising:

pump means for compressing air;

conduit means in fluid communication with said pump means for conveying compressed air from said pump means; and launch tube means in fluid communication with said conduit means for holding and launching a projectile, said launch tube means having an outer barrel having a closed end and a projectile exit end and an inner tube mounted longitudinally within and spaced from said outer barrel, said inner tube having an air entry end and an air exit end, and wherein said barrel has a selected internal configuration which generally corresponds to the projectile external configuration and said inner tube has a selected external configuration sized and shaped to be received within said projectile tail bore and thereby define an air channel between said projectile and said inner tube, whereby a burst of compressed air exiting said inner tube air exit end passes into the projectile bore and through the channel between the inner tube and the projectile to a position between the projectile tail and the closed end of the barrel.

8. The compressed air toy gun of claim 7 wherein said inner tube air exit end is positioned distally from said barrel projectile exit end and said barrel has vent means extending from adjacent said projectile exit end to a position at least generally level with said tube air exit end.

9. The compressed air toy gun of claim 7 wherein said inner tube has a bar extending across said air exit end.

10. The compressed air toy gun of claim 9 wherein said inner tube air exit end tapers outwardly from said bar.

11. A compressed air toy gun for firing projectiles having a tail bore comprising:

pump means for compressing air;

conduit means in fluid communication with said pump means for conveying compressed air from said pump means; and launch tube means in fluid communication with said conduit means for holding and launching a projectile, said launch tube means having an elongated projectile mounting tube configured to be received within the tail bore of the projectile, said mounting tube having an air entry end, an air exit end defining an air exit, a safety bar extending laterally across said air exit end, said mounting tube tapering outward from said safety bar so as to increase the area of said air exit.

12. The compressed air toy gun of claim 11 wherein said launching tube means further comprises an elongated barrel mounted longitudinally and concentrically about said mounting tube.

13. The compressed air toy gun of claim 12 wherein said outer barrel having a projectile exit end positioned distally from said mounting tube air exit end.

14. The compressed air toy gun of claim 13 wherein said barrel has a vent extending from adjacent said projectile exit end to a position at least generally level with said mounting tube safety bar.

15. The compressed air toy gun of claim 12 wherein the projectile has a selected external configuration and a selected internal configuration defining the bore, and wherein said barrel has a selected internal configuration substantially the same as the projectile external configuration, and said mounting tube has a selected external configuration sized and shaped to be received within said projectile tail bore and thereby define an air channel between said projectile and said mounting tube.

* * * * *